US006131974A

United States Patent [19]

Waugh

[11] Patent Number: 6,131,974

[45] Date of Patent: Oct. 17, 2000

[54] ROLLER GRAPNEL

[75] Inventor: Thomas R. Waugh, Portsmouth, R.I.

[73] Assignee: The United States of America as represented by the Secretary of the Navy, Washington, D.C.

[21] Appl. No.: 09/267,909

[22] Filed: Mar. 8, 1999

[51] Int. Cl.[7] ..... B66C 1/10

[52] U.S. Cl. ..... 294/66.1; 254/400; 294/82.1

[58] Field of Search ..... 294/1.1, 66.1, 294/82.1, 82.11, 82.14, 82.17, 82.27, 82.12, 902; 114/294, 301; 254/389, 390, 393–395, 397, 400, 409, 411; 405/158, 173

[56] References Cited

U.S. PATENT DOCUMENTS

| | | | |
|---|---|---|---|
| 1,736,193 | 11/1929 | Erdahl | 254/411 |
| 1,858,941 | 5/1932 | Salmon | 294/66.1 |
| 2,602,689 | 7/1952 | Matz | 294/66.1 |
| 3,195,862 | 7/1965 | Sherman | 254/390 |
| 4,417,718 | 11/1983 | Niskin | 254/394 |
| 4,423,853 | 1/1984 | Davis | 254/390 |
| 6,062,621 | 5/2000 | Zelany | 294/82.1 |

*Primary Examiner*—Johnny D. Cherry
*Attorney, Agent, or Firm*—Michael J. McGowan; James M. Kasischke; Prithvi C. Lall

[57] ABSTRACT

The present invention provides an improved grapnel which permits towed arrays to be retrieved more easily and with less chance of damaging the array. The invention includes a pair of U-shaped members attached to a center stock, the U-shaped members being attached in a perpendicular relationship to each other. A threaded rod connects each vertical portion of the U-shaped members to the center stock, and each row has a roller disposed thereon. The grapnel further includes a hub disposed on the center stock proximate the rollers and ramps respectively attached to each vertical portion of the U-shaped members, for guiding a towed array into engagement with the rollers.

16 Claims, 4 Drawing Sheets

ROLLER GRAPNEL

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

This invention relates generally to means for retrieving cable arrays which are towed on the surface of the ocean, and particularly, to a grapnel having rollers and ramps which enable a towed cable array to be retrieved without damaging the array.

(2) Description of the Prior Art

For the simulation of submarines during antisubmarine warfare exercises, naval personnel employ the use of cable arrays containing hydrophones, acoustic projectors, etc. These cable arrays are attached to and towed behind a torpedo-like vessel. When the exercise is completed, the vessel and array must be retrieved. In this regard, there are several existing devices which are used to retrieve marine targets, weapons, cable arrays, vessels, etc., floating on the ocean surface. One such device is disclosed in U.S. Pat. No. 5,494,240. This device enables a floating marine target to be retrieved by personnel in a helicopter hovering above the target. After the target is retrieved, the array must also be retrieved. Conventionally, simple grapnels having two U-shaped metal hooks positioned perpendicularly to each other and attached to a center stock are used to retrieve towed arrays. The array is retrieved by placing one of the metal hooks under the array and hoisting the array up to the helicopter. Although this type of grapnel is effective for retrieving arrays, it can develop sharp edges on the hooks, which can cause serious damage to the towed array. It can also cause high loads on the array, due to the friction as the array passes over the metal hook in a tight band, which can damage the array jacket and internal wires when it passes over the hook or where the array attaches to the target. The high loads also cause difficulty and fatigue to the grapnel operator.

Another type of grapnel used has two rollers positioned on either side of a center plate. In use, pairs of the grapnel are placed under the array and hoisted to the helicopter. The rollers reduce damage to the array by reducing the potential engagement with sharp edges associated with the above-described grapnel. Furthermore, since the array is allowed to shift on the grapnel with the aid of the rollers, damage is less likely to occur during its retrieval. However, this type of grapnel also has disadvantages in that it is 2–3 times heavier than the simple grapnel described above, and because the grapnel has only two pairs of rollers for capturing the array, the rollers being on opposite sides of the center plate, retrieval of the arrays is time consuming because twisting of the grapnel due to hydroplaning can make it difficult to line up the rollers with the array in order to capture it. Accordingly, there is a perceived need for an improved grapnel.

SUMMARY OF THE INVENTION

A first object of the invention is to provide an easier means of recovering towed arrays.

Another object of the invention is to provide such a means which does not damage the towed array.

Yet another object of the invention is to provide a light-weight grapnel which can be easily thrown and maneuvered.

The present invention provides an improved grapnel which permits towed arrays to be retrieved more easily and with less chance of damaging the array. The invention includes a pair of U-shaped members attached to a center stock, the U-shaped members being attached in a perpendicular relationship to each other. A threaded rod connects each vertical portion of the U-shaped members to the center stock, and each rod has a roller disposed thereon. The grapnel further includes a hub disposed on the center stock proximate the rollers, and ramps respectively attached to each vertical portion of the U-shaped members, for guiding a towed array into engagement with the rollers.

More specifically, the grapnel comprises a center stock having first and second U-shaped members attached at one end thereof. Each of the first and second U-shaped members has a first arm and a second arm extending from a point of attachment of each U-shaped member to the center stock. The first and second U-shaped members are oriented perpendicularly to each other. Each of the first and second arms of each of the first and second U-shaped members is connected to the center stock by a rod. Each rod is joined between each of the first and second arms and the center stock, and a roller is mounted on each of the rods. The grapnel also has guides for directing the towed array onto the rollers, including a hub disposed on the center stock proximate the intersection of the first and second rods and the center stock and ramps attached to each of the first and second arms of each of the first and second U-shaped members.

BRIEF DESCRIPTION OF THE DRAWINGS

The invention will be described with reference to the appended drawings, wherein.

Figure 1:
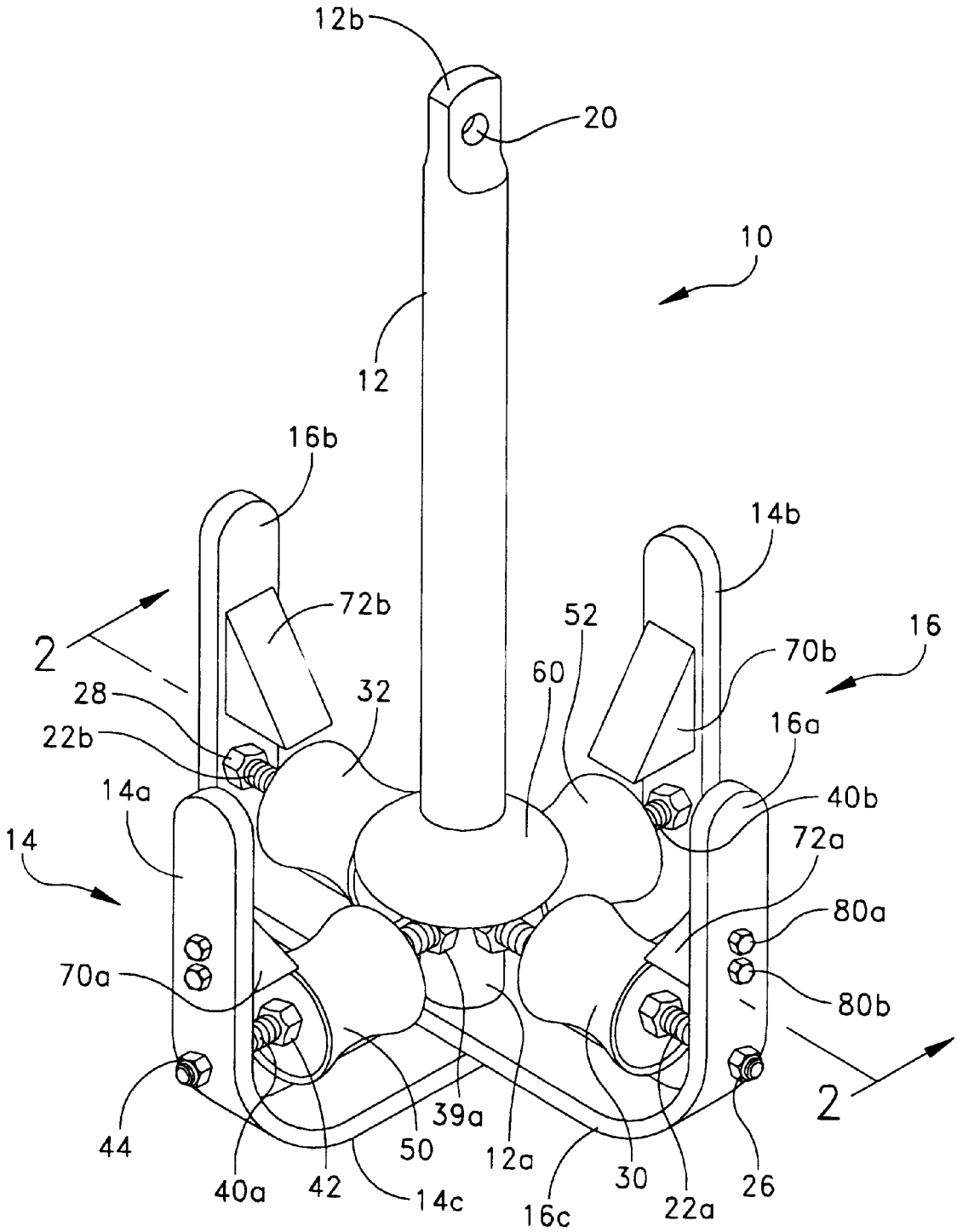
FIG. 1 is a perspective view of the roller grapnel of the present invention.

Common features of the invention are identified with common reference numerals in the multiple views provided of the invention.

DESCRIPTION OF THE PREFERRED EMBODIMENT

Figure 2:
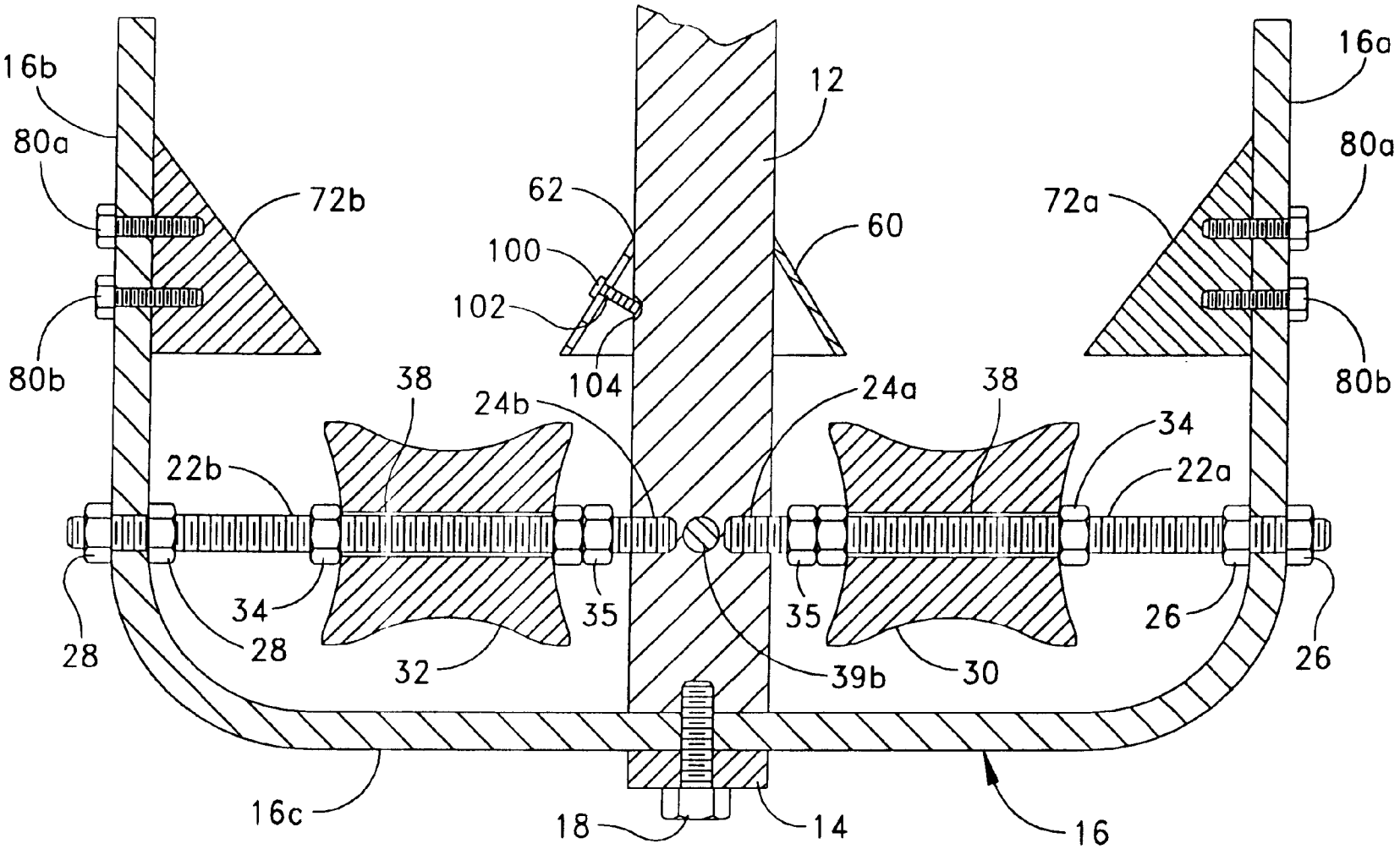
FIG. 2 is a cross-sectional view of the roller grapnel, taken along line 2—2 in FIG. 1.
Figure 3:
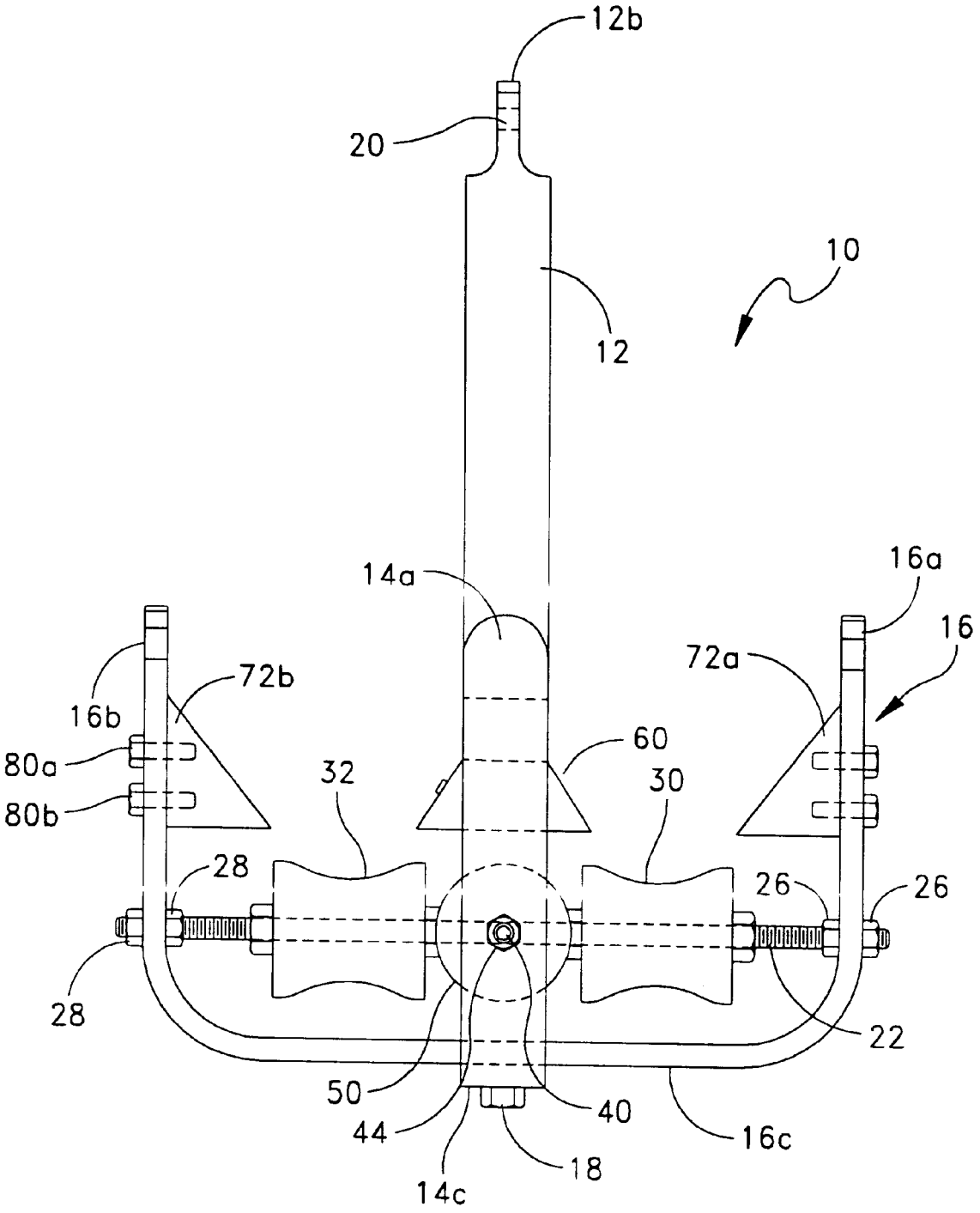
FIG. 3 is a side view of the roller grapnel of the present invention.

The roller grapnel of the present invention is illustrated and generally indicated at 10 in FIGS. 1–4. As will hereinafter be more fully described, the roller grapnel 10 includes improved features which will enable the safe retrieval of floating marine targets without damage thereto. Shown in FIG. 1 is a perspective view of the roller grapnel 10 of the present invention. FIG. 2 is a cross-sectional view of grapnel 10 taken along line 2—2 in FIG. 1, and FIG. 3 is a side view of roller grapnel 10. Roller grapnel 10 includes a center stock, generally indicated at 12, and U-shaped members, generally indicated at 14 and 16, respectively, which are bolted to the end 12*a* of center stock 12 with two bolts 18 (only one bolt 18 is shown for simplicity). At end 12*b* of center stock 12 is an opening 20, which facilitates the attachment of roller grapnel 10 to a line. U-shaped member 14 includes vertical portions 14*a* and 14*b*, which are connected by a horizontal portion 14*c*. U-shaped member 16 includes vertical portions 16*a* and 16*b*, which are connected by a horizontal portion 16*c*.

Two bolts 18 are inserted first through the openings near the midway point of horizontal portion 14*c* of U-shaped member 14 and then through two holes near the midway point of horizontal portion 16*c* of U-shaped member 16 and are threaded into end 12*a* of center stock 12 to hold U-shaped members 14 and 16 in place. As best shown in FIG. 2, threaded rods 22*a* and 22*b* interconnect vertical portions 16*a* and 16*b*, respectively, of U-shaped member 16 to threaded holes 24*a* and 24*b*, respectively, in center stock 12. Rod 22*a* is held in place between vertical portion 16*a* and center stock 12 with nuts 26 at vertical portion 16*a*. Rod 22*b* is held in place between vertical portion 16*b* and center stock 12, with nuts 28 at vertical portion 16*b*. Disposed on rods 22*a* and 22*b* are rollers 30 and 32, respectively. Rollers 30 and 32 are held in place along rods 22*a* and 22*b*, respectively, by self-locking nuts 34 on the outboard side and pairs of nuts 35 tightened against each other on the inboard side.

Similar to the above described connection of rods 22*a* and 22*b* and vertical portions 16*a* and 16*b* of U-shaped member 16, rods 40*a* and 40*b* connect vertical portions 14*a* and 14*b*, respectively, of U-shaped member 14 to center stock 12. Rod 40*a* is threaded into a threaded hole 39*a* of center stock 12 and is secured to vertical portion 14*a* by a nut 44; and rod 40*b* is threaded into threaded hole 39*b* of center stock 12 and is secured to vertical portion 14*b* by a nut (not shown). Holes 24*a*, 24*b*, 39*a*, and 39*b* intersect at the center of center stock 12. Disposed on rods 40*a* and 40*b* are rollers 50 and 52, respectively. As with rollers 30 and 32, rollers 50 and 52 are held in place on rods 40*a* and 40*b* by self-locking nut 42 on the outboard side and pairs of nuts (not shown) tightened together on the inboard side.

Roller grapnel 10 also comprises a hub 60 which is slip fit onto center stock 12. Hub 60 is conical in shape and has a hole 62 at the top thereof for fitting over center stock 12. Hub 60 is secured to center stock 12 with self-tapping screw 100, which is mounted through clearance hole 102 in hub 60 into interference hole 104 in center stock 12.

U-shaped member 14 further includes ramps 70*a* and 70*b* and U-shaped member 16 further includes ramps 72*a* and 72*b*. As best seen in FIG. 2, ramp 72*a* is attached to vertical portion 16*a* of U-shaped member 16 with screws 80*a* and 80*b*, which thread into ramp 72*a* through holes in vertical portion 16*a*. Ramps 72*a* and 72*b* are positioned just above rollers 30 and 32, respectively. Ramp 72*b* is attached to vertical portion 16*b* of U-shaped member 16 in the same fashion as ramp 72*a*. Likewise, ramps 70*a* and 70*b* are attached to vertical portions 14*a* and 14*b*, respectively, in the same manner. While in this embodiment, two screws are used to hold the ramps in place, it will be understood that any combination of screws and/or pins, etc. may be used to attach the ramps to the vertical portions and to prevent the ramps from rotating.

Figure 4:
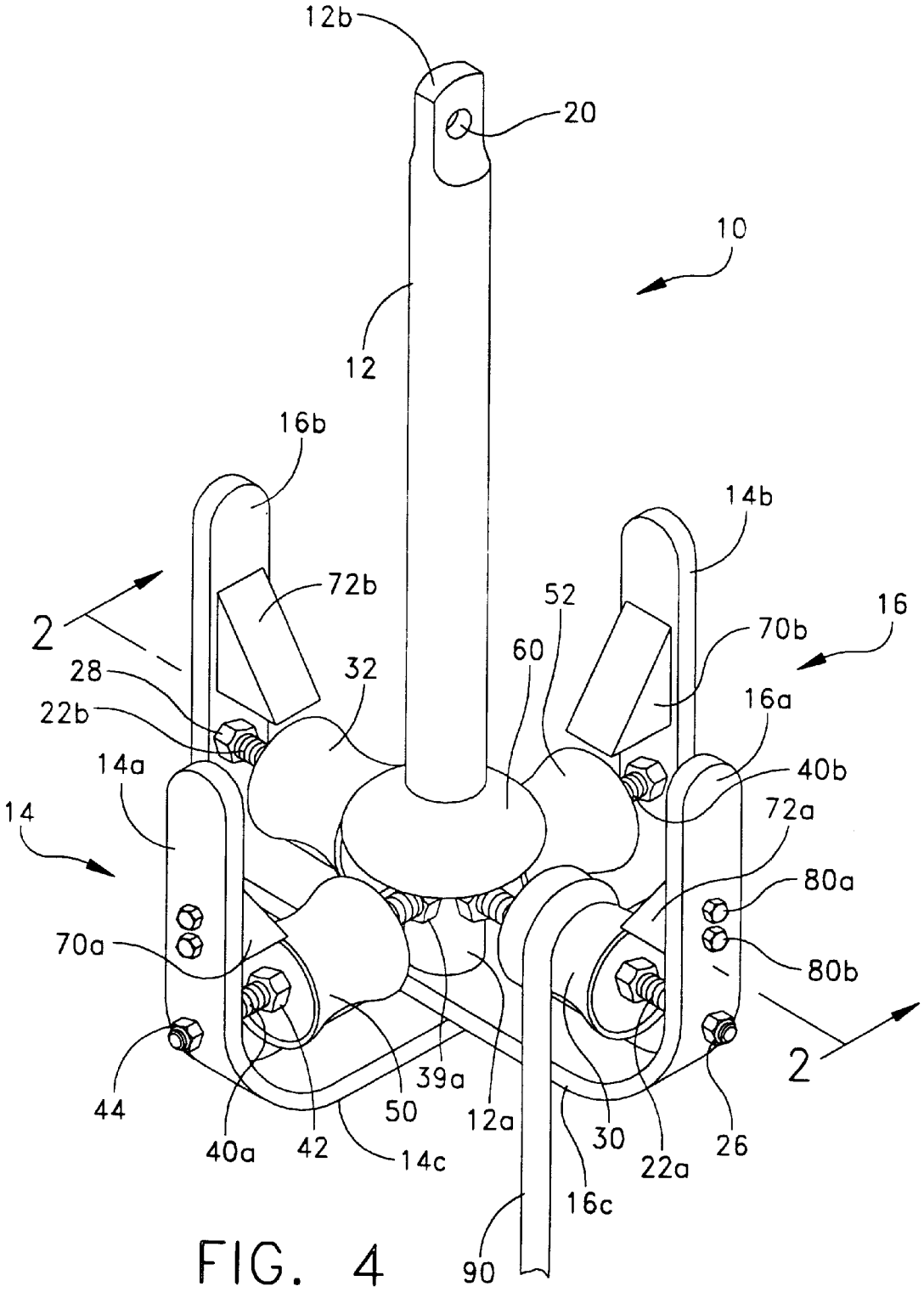
FIG. 4 is a perspective view showing an array captured on the roller grapnel of FIG. 1.

In operation, the roller grapnel is lowered from a helicopter to retrieve a towed array which is attached to a marine target. After the target is recovered, the helicopter moves slowly forward and to the side to stream the array on the ocean surface. The grapnel is then lowered to the ocean surface in an attempt to capture the array between one of the vertical portions 14*a*, 14*b*, 16*a* and 16*b* and center stock 12. When the array is located between one of the vertical portions and the center stock 12, the roller grapnel 10 is raised toward the helicopter to capture the array 90 with the roller grapnel 10, as shown in FIG. 4. When roller grapnel 10 is raised, hub 60 and, in this example, ramp 72*a* act to guide array 90 onto roller 30. Hub 60 and ramp 72*a* also prevent array 90 from becoming wedged between roller 30 and center stock 12 or vertical portion 16*a*. The concave surface of the roller forces the array towards the middle of the roller and away from its ends, where the array could be pinched between roller and ramp or hub. Since roller 30 is able to rotate freely on rod 22, it provides a relatively low friction surface on which array 90 may be raised. In this way, the array can move along roller 30 and, when the 2-inch diameter hydrophone reaches roller 30, the spacing between the ramp and hub allows it to pass through without interference; and the array is then raised up to the helicopter.

The design and positioning of the ramps 70*a*, 70*b*, 72*a* and 72*b*, hub 60 and rollers 30, 32, 50 and 52 eliminate the sharp edges and tight bends associated with the simple grapnel and enable towed arrays to be retrieved more easily and without damage, which, as described above, occurred in the prior art simple grapnels. In contrast with the two-roller grapnel of the prior art, the present invention makes array retrieval easier because it is easier to align one of the four rollers of the present invention with the array than it is to align one of the two opposing pairs of rollers of the prior art grapnel with the array.

Furthermore, the present invention allows the prior art simple grapnel to be modified to operate as the roller grapnel of the present invention. This is done by drilling holes through a center stock and vertical portions of a simple grapnel to mount rods 22*a* and 22*b* and 40*a* and 40*b* as described above. Rollers 30, 32, 50 and 52 can be provided on the rods as described above, and a hub 60 and ramps 70*a*, 70*b*, 72*a* and 72*b* can be mounted on the grapnel as described above with reference to FIGS. 1–3.

Typically, center stock 12 and U-shaped members 14 and 16 are made from aluminum. However, it will be understood that any suitable material may be used in the construction of center stock 12 and U-shaped members 14 and 16. Rollers 30, 32, 50 and 52, hub 60 and ramps 70*a*, 70*b*, 72*a* and 72*b* are typically made from a material such as nylon. However, it will be understood that any suitable material may be used in the construction of these elements. Although rollers 30, 32, 50 and 52 are shown in the figures as directly contacting rods 22 and 40, the rollers may include bearings 38 and/or shims for reducing the rolling resistance of the rollers and for increasing the durability of the rollers.

While there is shown and described herein certain specific structure embodying the invention, it will be manifest to those skilled in the art that various modifications and rearrangements of the parts may be made without departing from the spirit and scope of the underlying inventive concept. Therefore, the invention is not limited to the particular forms herein shown and described except insofar as indicated by the scope of the appended claims.

What is claimed is:

1. A grapnel for recovering a towed array comprising:

a center stock having first and second ends, said first end being capable of attaching to a line;

a plurality of flukes jointed to said second end of said center stock, each said fluke having a horizontal portion and a vertical portion;

a plurality of rods with each said rod joined between one said fluke vertical portion and said center stock;

a plurality of rollers with each said roller rotatably positioned on one said rod between said fluke vertical portion and said center stock; and a directing means positioned on said flukes and said stock for directing said towed array onto said rollers.

2. The grapnel of claim 1 wherein said directing means comprises a hub disposed on said center stock proximate an intersection of said rods and said center stock.

3. The grapnel of claim 2 wherein said directing means further comprises ramps attached to each fluke vertical portion.

4. The grapnel of claim 1 wherein said directing means comprises ramps attached to each fluke vertical portion.

5. A roller grapnel for capturing towed arrays comprising:

a center stock;

a first U-shaped member having first and second vertical portions connected by a horizontal portion;

a second U-shaped member having first and second vertical portions connected by a horizontal portion, said first and second U-shaped members being attached at said horizontal portions to an end of said center stock in a perpendicular relationship with each other such that said vertical portions are oriented generally along said center stock;

a plurality of roller mechanisms joined between each U-shaped member vertical portions and said center stock comprising:

a rod attached between said vertical portion of said U-shaped member and said center stock;

a roller rotatably disposed on said rod between said vertical portion of said U-shaped member and said center stock; and a guide means for guiding said towed arrays onto said roller mechanisms.

6. The roller grapnel of claim 5 wherein said guide means comprises a hub mounted on said center stock proximate said roller mechanisms.

7. The roller grapnel of claim 5 wherein said guide means comprises a downwardly sloping ramp attached to each of said vertical portions of each of said first and second U-shaped members proximate said roller mechanisms.

8. The roller grapnel of claim 7 wherein said guide means further comprises a hub mounted on said center stock proximate said roller mechanisms.

9. A grapnel comprising:

a center stock;

at least three L-shaped arms depending from said center stock, said L-shaped arms being circumferentially spaced around said center stock; and a roller rotatably mounted between said center stock and each of said arms.

10. The grapnel of claim 9 further comprising a guiding means for guiding a target object into engagement with said roller.

11. The grapnel of claim 10 wherein said guiding means comprises a hub mounted on said center stock.

12. The grapnel of claim 11 wherein said hub tapers outwardly and downwardly from said center stock toward said arms.

13. The grapnel of claim 11 wherein said guiding means comprises a ramp mounted to each of said L-shaped arms.

14. The grapnel of claim 13 wherein each of said ramps tapers inwardly and downwardly from said L-shaped arms toward said center stock.

15. The grapnel of claim 10 wherein said guiding means comprises a ramp mounted to each of said L-shaped arms.

16. The grapnel of claim 15 wherein each of said ramps tapers inwardly and downwardly from said arms toward said center stock.

* * * * *